US011535997B2

(12) United States Patent
Farrell

(10) Patent No.: US 11,535,997 B2
(45) Date of Patent: Dec. 27, 2022

(54) MODULAR BUILDING BLOCK APPARATUS

(71) Applicant: Lock-A-Block (N.I.) Limited, Craigavon (GB)

(72) Inventor: John Farrell, Craigavon (GB)

(73) Assignee: Lock-A-Block (N.I.) Limited, Craigavon (GB)

( * ) Notice: Subject to any disclaimer, the term of this patent is extended or adjusted under 35 U.S.C. 154(b) by 0 days.

(21) Appl. No.: 17/280,443

(22) PCT Filed: Sep. 10, 2019

(86) PCT No.: PCT/EP2019/074063
§ 371 (c)(1),
(2) Date: Mar. 26, 2021

(87) PCT Pub. No.: WO2020/064321
PCT Pub. Date: Apr. 2, 2020

(65) Prior Publication Data

US 2022/0002960 A1 Jan. 6, 2022

(30) Foreign Application Priority Data

Sep. 28, 2018 (GB) ..... 1815813

(51) Int. Cl.
*E02B 3/14* (2006.01)
*E02B 3/10* (2006.01)
(Continued)

(52) U.S. Cl.
CPC ..... *E02B 3/14* (2013.01); *E02B 3/108* (2013.01); *E02D 17/205* (2013.01); *E02D 29/025* (2013.01); *E02D 29/0233* (2013.01); *E02D 29/0266* (2013.01); *E02D 2200/13* (2013.01); *E02D 2300/0004* (2013.01);
(Continued)

(58) Field of Classification Search
CPC ..... E02B 3/14; E02B 3/108; E02D 17/205; E02D 29/025; E02D 2200/13; E02D 29/0233; E02D 2600/30; E02D 29/0266; E02D 2600/20; E02D 2300/0075;
(Continued)

(56) References Cited

U.S. PATENT DOCUMENTS

X422901 3/1890 Arnett
5,511,902 A 4/1996 Center
(Continued)

FOREIGN PATENT DOCUMENTS

WO 2015/176084 11/2015

OTHER PUBLICATIONS

US 6,089,793 A, 07/2000, Rainey (withdrawn)
International Search Report of corresponding PCT Application No. PCT/EP2019/074063, dated Nov. 7, 2019.

*Primary Examiner* — Carib A Oquendo
(74) *Attorney, Agent, or Firm* — Gardner Linn

(57) ABSTRACT

A modular building block apparatus for the construction of a coastal or river bank erosion defence or protection structure includes a plurality of blocks arranged in stacked rows, the blocks in each row having cooperating formations whereby the blocks in each row are interconnected with one another. Apertures formed in each block extend perpendicular to the rows, and a plurality of connector members extend through aligned apertures in adjacent rows of the blocks to interlock the rows to one another.

20 Claims, 5 Drawing Sheets

(51) Int. Cl.
*E02D 17/20* (2006.01)
*E02D 29/02* (2006.01)

(52) U.S. Cl.
CPC .. *E02D 2300/0075* (2013.01); *E02D 2600/20* (2013.01); *E02D 2600/30* (2013.01)

(58) Field of Classification Search
CPC ..... E02D 2300/0004; E04B 2/08; E04B 2/18; E04B 2/16
See application file for complete search history.

(56) References Cited

U.S. PATENT DOCUMENTS

| | | | | |
|---|---|---|---|---|
| 6,004,067 | A | 12/1999 | Peppard | |
| 8,499,395 | B2 | 8/2013 | Wallerstrom | |
| 10,273,683 | B2 * | 4/2019 | Fryfogle | E04B 2/12 |
| 2005/0257481 | A1 * | 11/2005 | Shaw | E04B 2/04 52/606 |
| 2010/0074687 | A1 | 3/2010 | Boudreaux, Jr. | |
| 2013/0036700 | A1 * | 2/2013 | Speer | E04C 1/00 52/745.1 |
| 2015/0063924 | A1 * | 3/2015 | Brookhart | E02D 29/0266 405/284 |
| 2018/0245339 | A1 * | 8/2018 | Hon | E04C 1/397 |

* cited by examiner

MODULAR BUILDING BLOCK APPARATUS

CROSS REFERENCE TO RELATED APPLICATIONS

The present application is a § 371 national stage of International Application PCT/EP2019/074063, filed Sep. 10, 2019, which claims priority benefit to U.K. Pat. Application Ser. No. 1815813.9, filed Sep. 28, 2018, both of which are hereby incorporated herein by reference in their entireties.

FIELD OF THE INVENTION

The present invention relates to building materials, in particular to a modular building block apparatus and in particular to a modular building block apparatus for forming a coastal or river bank erosion defence or protection structure.

BACKGROUND TO THE INVENTION

Water barriers are typically installed along stretches of the coast or river banks where high water levels can pose a significant risk to surrounding structures. Furthermore the constant battering from waves can cause significant damage to coastlines and as a result barrier apparatus are typically installed to both protect the coastline from erosion and also protect nearby homes. Examples of this type of apparatus include seawalls, levees and gabions. It is well known that the construction of these structures can be a long and tedious process as the construction depends on how much of the structure can be built in between high and low tide, with certain sections having to be completed before the high tide returns. This means that construction has to be run on a very restricted schedule and delays are a common occurrence. Furthermore these structures all require a significant amount of labour to install.

Alternative defences have also typically been employed to a somewhat limited effect. These include the use of sheet iron piling which is installed along a coastline. This form of sea defence has a significantly reduced capability because, when waves crash against the structure, a portion of the water falls behind the structure and over time this water accumulates with the resultant force of this water pushing the structure forward until it eventually collapses. Another alternative defence is the use of sandbags which are typically used to create artificial dunes. However sandbags are inefficient because they readily become saturated and allow for the ingress of water, when placed along a coastline. Furthermore, the constant battering of the waves is prone to tearing the sandbags apart, rendering them substantially redundant as a barrier structure.

SUMMARY OF THE INVENTION

The present invention provides a modular building apparatus that is relatively easy to install, is customisable to the user's needs, and creates a barrier capable of withstanding the constant battering of waves along a coastline when installed.

According to a first aspect of the present invention there is provided a modular building block apparatus for the construction of a coastal or river bank erosion defence or protection structure, the apparatus comprising a plurality of blocks arranged in stacked rows, the blocks in each row having cooperating formations whereby the blocks in each row are interconnected with one another, apertures being formed in each block extending perpendicular to the rows, a plurality of connector members extending through aligned apertures in adjacent rows of the blocks to interlock the rows to one another.

The cooperating formations of each block may comprise at least one male engagement portion extending laterally from the body of the block and at least one cooperating female engagement portion provided in the body of the block for receiving the male engagement portion of an adjacent block.

In one embodiment a plurality of the rows of blocks are layered on top of one another in staggered or stepped relationship.

The female engagement portion of each block may be shaped to prevent the lateral movement of the cooperating male engagement portion of an adjacent block in a respective row when received therein.

The male engagement portion may comprise an exterior projection which extends laterally from the body of each bock.

In one embodiment each block may comprise first and second sides and first and second ends along with a base and top, the first and second sides being substantially parallel to each other and the first and second ends being substantially parallel to each other such that each block has a substantially cuboid shape.

Optionally, at least one channel extends substantially across at least one face of each block to define a drainage channel between adjacent rows of the blocks when the blocks are in abutting stacked relationship. The channel may comprise an elongate groove formed in a face of each block.

In one embodiment at least one of the apertures of each block of each row is aligned with an aperture of a block in an adjacent row, a respective connector member extending through the aligned apertures to interconnect the rows of blocks. Each of the connector members may comprise an elongate post, rod or pin dimensioned to fit through the aligned apertures in the blocks. Optionally, each connector member has a pointed or tapered end adapted to be inserted into a surface upon which the blocks are located. Each aperture of each block may have tapered walls such that a respective connector member is an interference fit therein.

Optionally, each block is made from an impermeable material. In one embodiment each block may be made from geopolymer cement, for example.

At least one layer of fabric or mesh may be located between adjacent rows of the blocks, the layer of fabric or mesh extending laterally from the blocks to be embedded in a body of material against which the apparatus is located, in use, to anchor the apparatus to the body of material.

According to a further aspect of the present invention there is provided a coastal or river bank erosion defence or protection structure comprising a modular building block apparatus in accordance with the first aspect of the invention.

These and other objects, advantages and features of the invention will become apparent upon review of the following specification in conjunction with the drawings.

BRIEF DESCRIPTION OF THE DRAWINGS

An embodiment of the invention is now described by way of example and with reference to the following drawings in which.

DETAILED DESCRIPTION OF THE PREFERRED EMBODIMENTS

Figure 1:
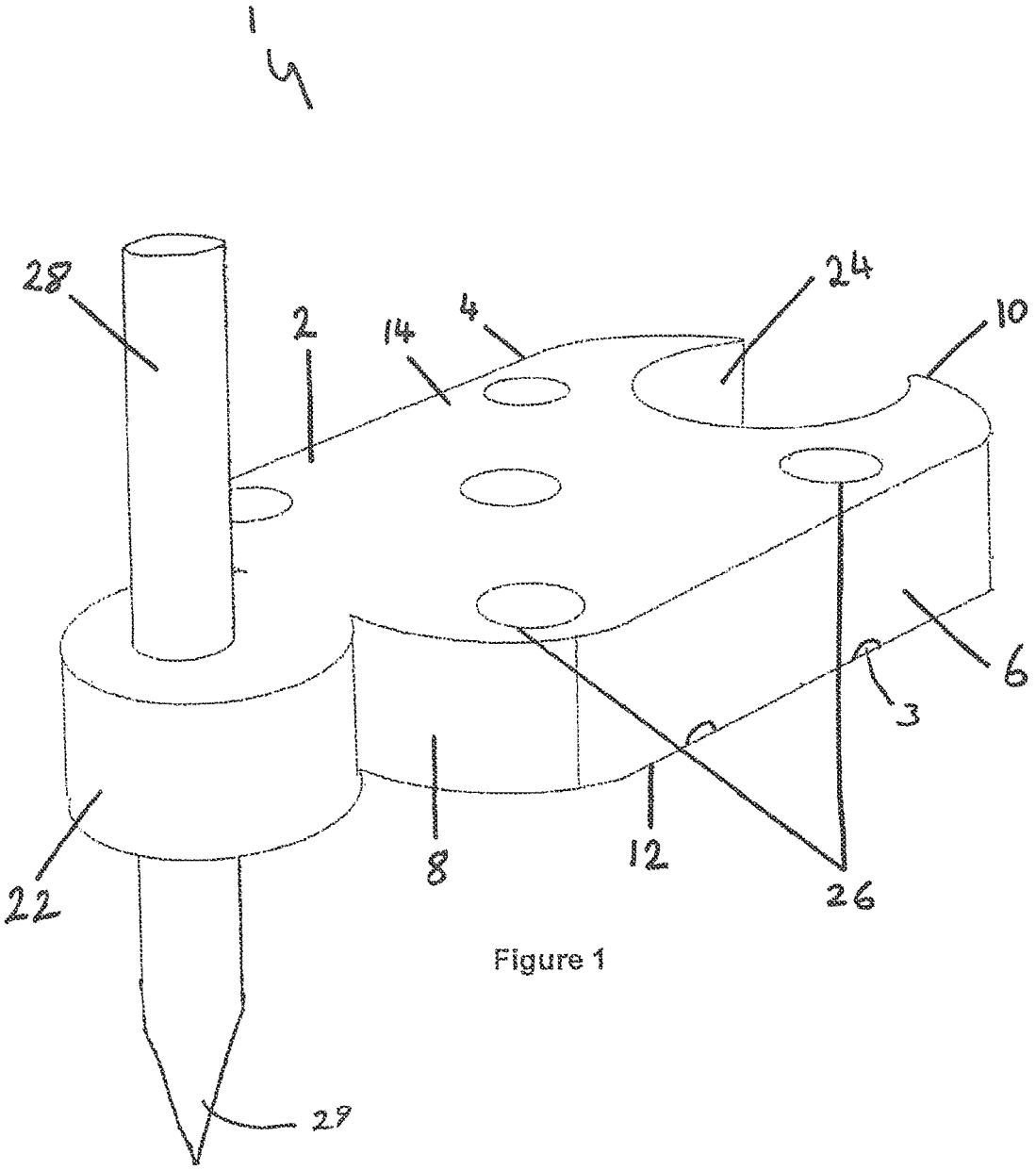
FIG. 1 is a perspective view of a building block apparatus in accordance with a first embodiment of the invention.
Figure 2:
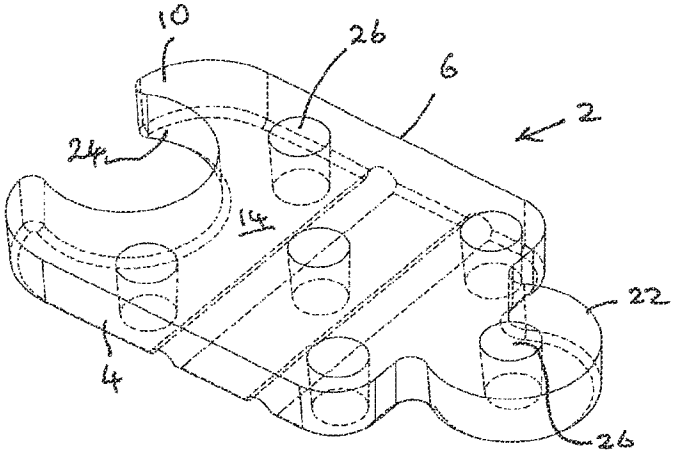
FIG. 2 is a perspective view of the building block of FIG. 1 showing hidden detail.
Figure 3:
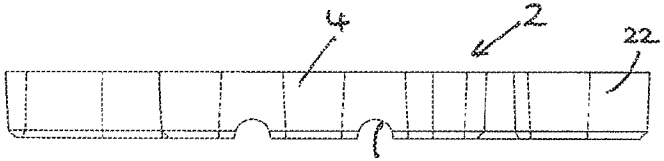
FIG. 3 is a side view of the building block of FIG. 1.
Figure 5:
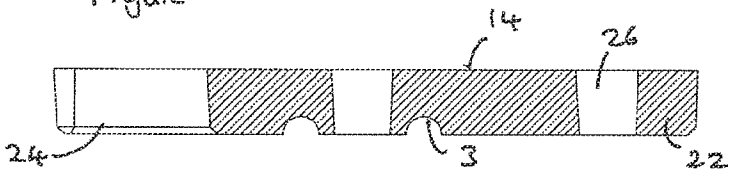
FIG. 5 is a sectional view on line A-A of FIG. 4.
Figure 4:
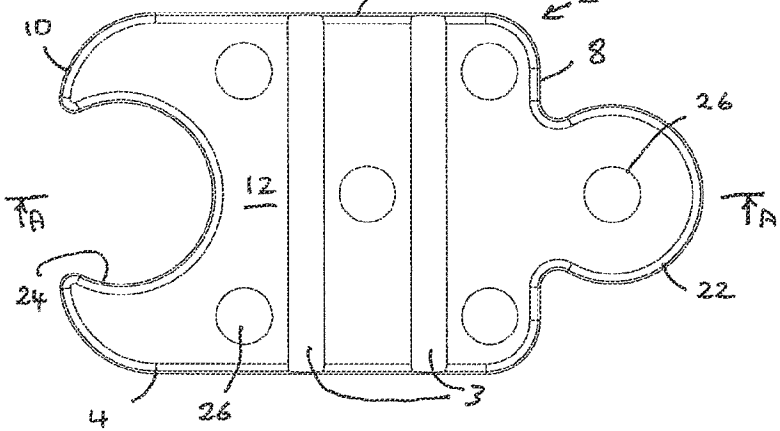
FIG. 4 is a plan view from below of the building block of FIG. 1.

FIGS. 1 to 5 illustrate a modular building block apparatus in accordance with an embodiment of the present invention, which is generally indicated by the reference numeral 1. The apparatus 1 comprises a block 2. The block 2 has a plurality of exterior faces. In the first embodiment the block 2 is defined by first and second sides 4, 6 and first and second ends 8, 10 along with a base 12 and top 14. The first and second sides 4, 6 are substantially parallel to each other and the first and second ends 8, 10 are substantially parallel to each other such that the block 2 has a substantially cuboid shape. Typically the block 2 has rounded corners. The block may have both male and female engagement portions 22, 24 or at least one of the portions.

In the illustrated embodiment the block 2 has at least one male engagement portion 22 and at least one female engagement portion 24. The at least one male and female engagement portions may be located on any of the exterior faces of the block 2. The at least one male and female engagement portions are shaped to have substantially corresponding dimensions. One end 8 of the block 2 has a male engagement portion 22 which extends from the body of the block 2 in a substantially lateral direction. The male engagement portion 22 comprises an exterior projection. In the illustrated embodiment the male engagement portion is substantially cylindrical shaped. The male engagement portion 22 is approximately the same height as the block 2. At least one end 10 of the block 2 has a female engagement portion 24. The female engagement portion 24 is typically shaped and dimensioned to define a recess. In the illustrated embodiment the female engagement portion 24 is substantially cylindrically shaped. The female engagement portion 24 is typically shaped and dimensioned to correspond to and receive the male engagement portion 22.

Optionally, the block 2 may be made from a substantially impermeable material. For example, the block 2 may be made from rubber, plastics, cement, wood any combination thereof. In a preferred embodiment each block 2 may be made from geopolymer concrete. In one embodiment each block is made from a polypropylene fibre/concrete mix or a stainless steel fibre/cement mix as follows:—

Polypropylene Fibre Mix:—
OP Cement to BS EN 197-1 225 kg/m$^3$
PFA/GGBS 155 kg/m$^3$
Total=380 kg/m$^3$
W/C=0.45
With 4 kg/m$^3$ ADFIL Micro Fibre Durus S400
Stainless Steel Fibre Mix:—
OP Cement to BS EN 197-1 225 kg/m$^3$
PFA/GGBS 155 kg/m$^3$
Total=380 kg/m$^3$
W/C=0.45
With 30 kg/m$^3$ S/S Draymix I/d 45

The block 2 typically incorporates at least one channel 3. The at least one channel 3 typically extends substantially across at least one face of the block 2. In one embodiment, the block 2 may have first and second channels 3 which extend across the base 12, the channels 3 extending parallel to ends 8 and 10. Advantageously, the (or each) channel 3 allows for the flow of water through the and/or under the block 2 in use. The at least one channel 3 typically comprises an elongate groove. In an alternative embodiment the block 2 may be shaped to incorporate one or more channels which may extend laterally through the body of the block.

In the first embodiment the block 2 incorporates a plurality of apertures 26. The apertures are typically located on the base and top faces 12, 14. The apertures 26 typically extend the full height of the block 2. One or more connector members, each in the form of an elongate pin or rod 28 (hereinafter referred to as a "connector rod"), are insertable into, and preferably through, any one or more of the apertures 26. Each connector rod 28 is typically of substantially greater height than the aperture 26. The connector rods 28 may each extend the height of a plurality of modular blocks 2. Each connector rod 28 may be insertable through a plurality of adjacent modular blocks 2 in use to secure the blocks together. Each connector rod 28 may have a tapered point 29 to allow it be to driven into the ground beneath the blocks. Each connector rod 28 may comprise an elongate rod or post made from wood, metal, rubber, plastic, stone or concrete. In one embodiment each connector rod may comprise a metal pipe, more preferably formed from stainless steel for corrosion resistance, and may be infilled with concrete for additional ballast. In an alternative embodiment each connector rod 28 may comprises an elongate rod or post manufactured from wood, such as oak.

Figure 6:
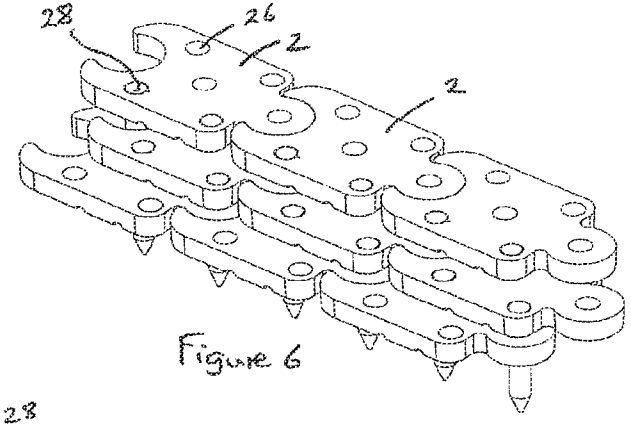
FIG. 6 is a perspective view of a plurality of the building blocks of FIG. 1 in use.
Figure 7:
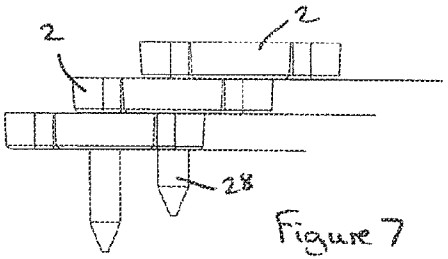
FIG. 7 is an end view of the blocks of FIG. 6.
Figure 8:
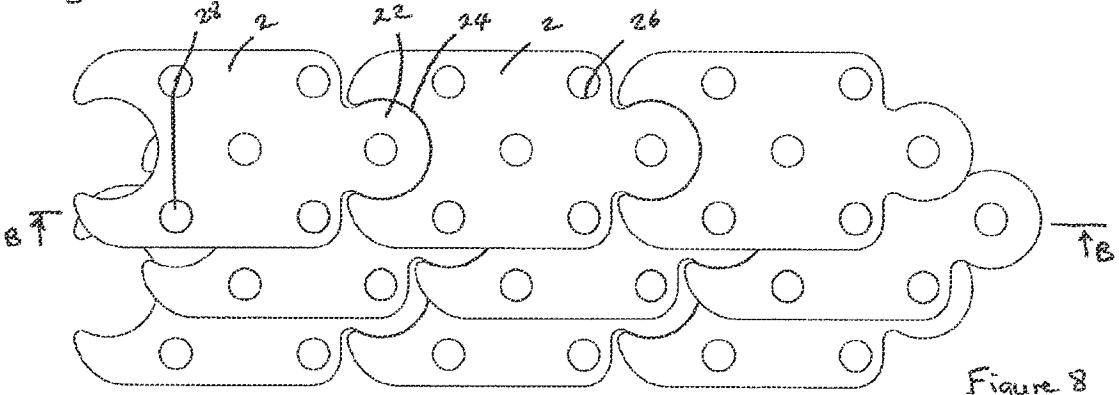
FIG. 8 is a plan view of the blocks of FIG. 6.

As illustrated in FIGS. 6 to 8, a plurality of adjacent interlocking building blocks 2 are adapted to be connectable together via the male and female engagement portions 22, 24 and the connector rods 28 to enable the blocks 2 to be assembled to form a three dimensional structure, comprising a plurality of stacked rows. Such structure may comprise a coastal or river bank defence structure, a bridge abutment, a wall or any other structure, in particular a structure intended to prevent erosion or collapse of a body against which the structure is placed. Such body may comprise a layer of back fill placed behind the structure defined by the interlocking blocks.

The connection between adjacent blocks 2 in each row is formed by the engagement of the corresponding male and female engagement portions 22, 24 of the blocks 2. In the illustrated embodiment the male engagement portion 22 is slidably connectable with the female engagement portion 24. The female portion 24 only allows for the longitudinal movement of the male engagement portion 22 when connected. The female engagement 24 portion prevents lateral movement of the male engagement portion 22 when connected. Alternatively, the male and female engagement portions may be shaped and dimensioned to form an interference fit when engaged. A plurality of adjacent modular blocks 2 can be connected together in this manner to form an elongate section of connected blocks.

The plurality of blocks 2 may be adapted to be connected at various angles with respect to one another. Advantageously, this allows the blocks 2 to be connected into a shape corresponding to the user's requirements. Furthermore, in the illustrated embodiment a plurality of elongate block sections or rows can be layered on top of one another to form a wall like structure 25. The height and width of the wall 25 may be determined by the number of layers of connected block sections or rows. In the illustrated embodiment a plurality of rows of connected blocks are layered on top of one another with each alternating layer of blocks being staggered. The arrangement of the holes 26 in each block 2 facilitates such staggered or stepped arrangement. Advantageously, when the connected block sections are layered on top of one another the at least one aperture 26 of each block 2 aligns with the aperture of the block 2 layered above and/or below. The alignment of the apertures 26 of various layers of blocks 2 allows for the connector rods 28 to be inserted through the plurality of apertures 26.

The connector rods 28 prevent the disconnection of the connected block sections or rows in use. Further advantageously the at least one channel 3 of each block 2 allows for water to be able to flow through the wall like structure 25 in use.

Figure 12:
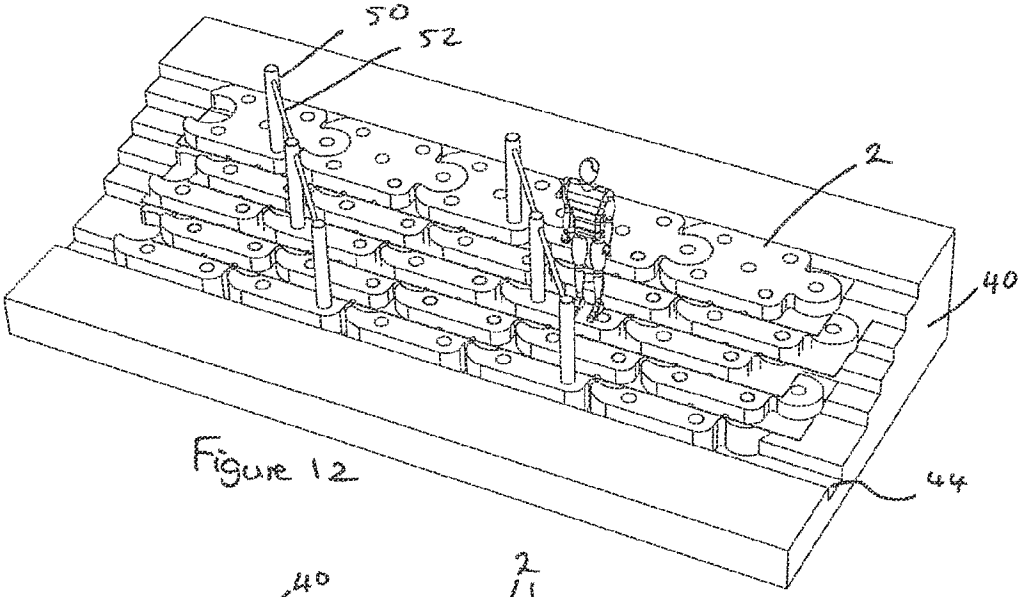
FIG. 12 is a perspective view of a plurality of the building blocks of FIG. 1 when used to create a coastal or river bank defence structure.
Figure 14:
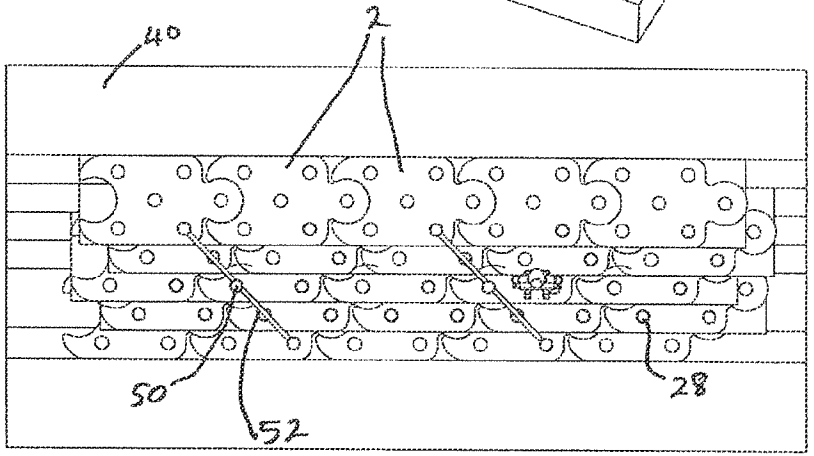
FIG. 14 is a plan view of the structure of FIG. 12.
Figure 13:
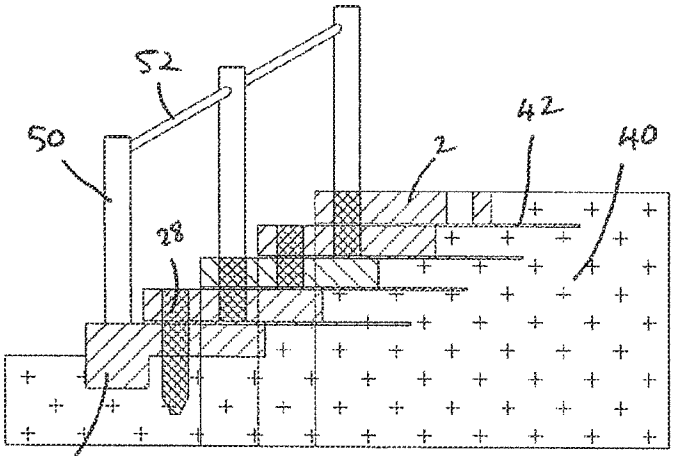
FIG. 13 is a sectional view through the structure of FIG. 12.

FIGS. 12 to 14 illustrate the use of the blocks of FIGS. 1 to 5 to form a coastal or river bank defence structure to prevent erosion, wherein multiple rows of blocks 2 are layered in staggered configuration over a sloping bank or layer of back fill 40.

Figure 11:
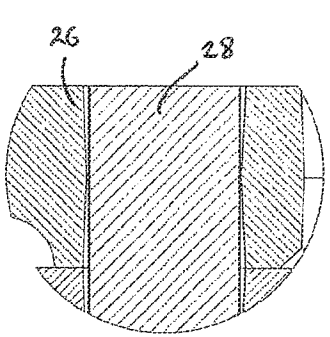
FIGS. 10 and 11 are detailed views of the interaction between the retaining rods and the apertures in the blocks of FIG. 6.
Figure 10:
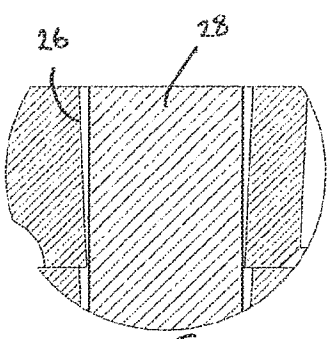
Figure 9:
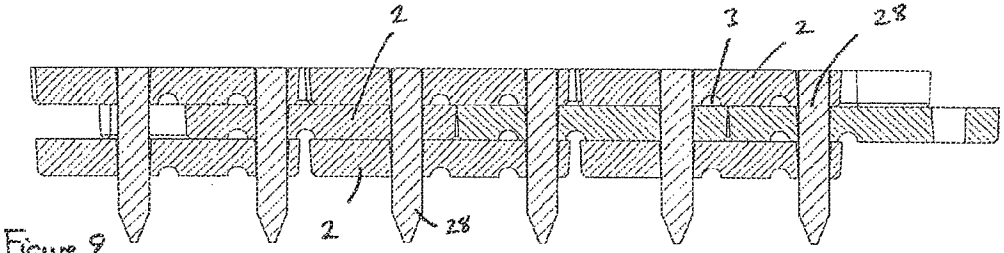
FIG. 9 is a sectional view on line B-B of FIG. 8.

As illustrated in FIGS. 10 and 11, the apertures 26 in the blocks 2 may have tapered sides so that the connector rods 28 are gripped within the apertures 26 in an interference fit.

The channels 3 formed in the lower faces of the blocks allow water to drain between the layers of blocks to prevent the build up of water behind the blocks, which might otherwise undermine the structure.

Geotextile grids 42 may be provided between the layers of blocks 2, extending into the bank/backfill 40, to anchor the blocks to the bank/backfill 40.

A lowermost row of blocks defining the bottom of the structure may include an enlarged toe 45, defining a downwardly extending projection preferably depending from the front side of the blocks, the toe 45 being received in a trench 44 at the bottom of the bank 40 to reduce scouring and enhance the stability of the structure and the underlying bank/layer of backfill 40.

The stepped arrangement of the blocks 2 may facilitate pedestrian access to the adjacent location, for example to a beach.

As well as receiving the connector rods 28 for securing the rows of blocks 2 to one another, the apertures 26 in the blocks 2 may be used to receive posts 50 upon which may be mounted handrails 52, as shown in the drawings.

Unused apertures 26 in the blocks 2 may be plugged if desired, for example to reduce turbulence.

Figure 16:
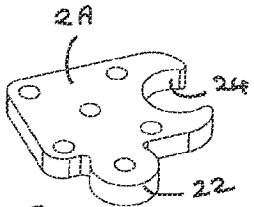
Figure 15:
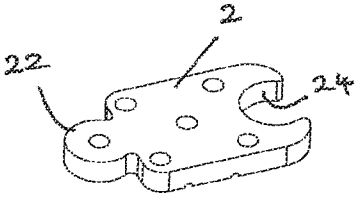

FIGS. 15 to 18 illustrate different shaped blocks 2, 2A, 2B, 2C which may be used to facilitate the assembly of various structures. FIG. 16 shows a corner building block for use with the building block apparatus 1 which is generally indicated by the reference numeral 2A. The block has male and female engagement portions 22,24 arranged at 90° to one another located on adjacent sides of the block. This arrangement of the engagement portions 42, 44 allows this embodiment to serve as a corner section of the modular block wall.

Figure 18:
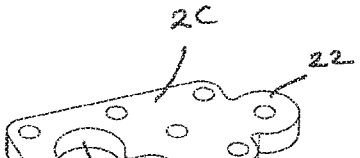
FIGS. 15 to 18 illustrate different shaped blocks in accordance with embodiments of the present invention.
Figure 17:
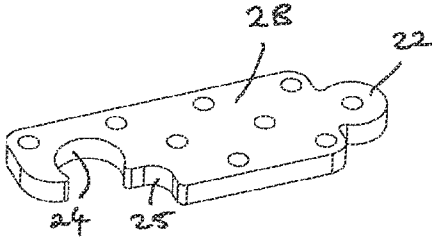
Figure 19:
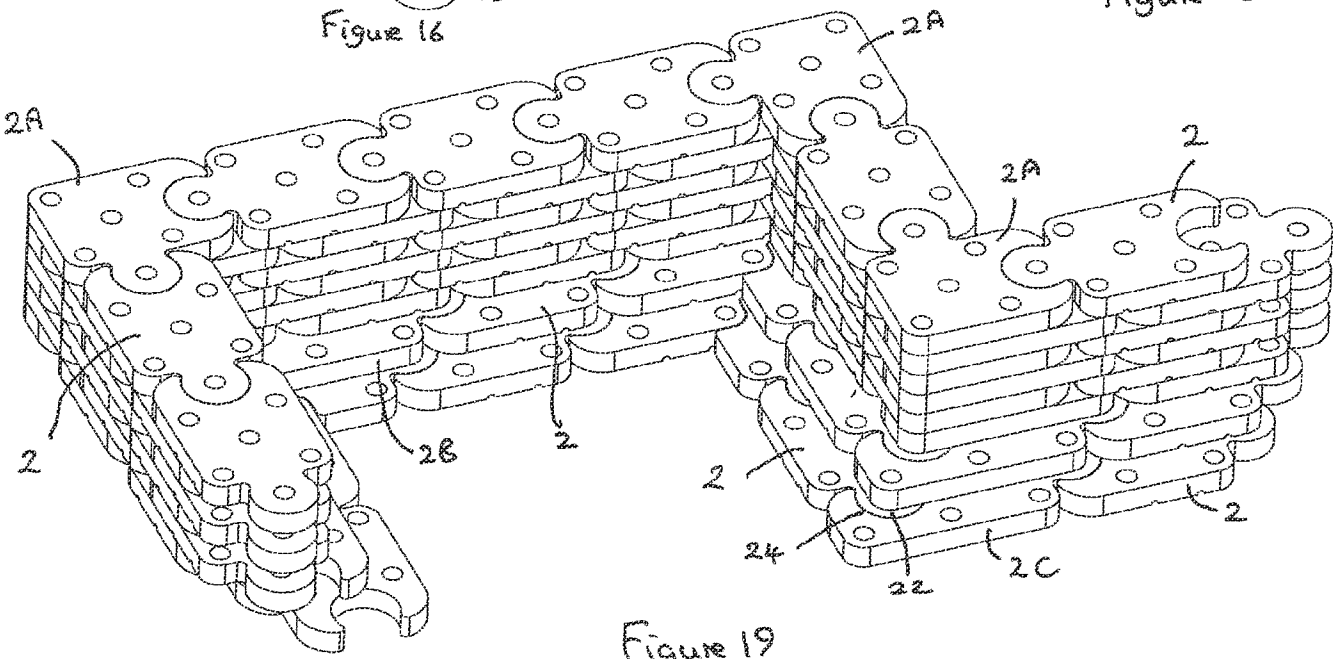
FIG. 19 illustrates the different shaped blocks in use.

FIGS. 17 and 18 illustrate alternative corner building blocks 2B, and 2C having different dimensions to facilitate the assembly of the blocks into different shaped structures, as shown in FIG. 19. The female engagement portions 24 of these corner blocks are recessed into the long sides of the blocks 2B, 2C, requiring additional cut out portions 25 for receiving the end portions 8 of the adjacent blocks 2 adjacent the blocks cooperating male engagement portions 22.

The width of each building block 2, (from side 4 to side 6) may be approximately 1000 mm. The length of each building black including the male engagement portion 22, may for example be approximately 1820 mm. The height of each building block 2 may for example be approximately 200 mm. It may be desirable that the length of the male engagement portion 22 is substantially the same or similar as the length of the recess of the female engagement portion 24. In the case of the corner building blocks it is desirable that the length and height of the blocks 32, 52 is substantially the same or similar as the length and height of the block 2. The at least one channel 3 is typically 70 mm wide with a depth of 50 mm. The channel 3 typically extends the total width (1000 mm) of the block 2. The connector rods 28 may have a length of approximately 600 mm and a diameter of approximately 150 mm. Optionally, the blocks 2 and connector rods 28 may be of substantially greater or lesser dimension.

In the embodiments described above the blocks 2 are preferably solid blocks. Alternatively, the blocks 2 may be hollow with an inlet (not shown) for the intake and removal of a ballast material, such as sand or water.

In the embodiment described above the apparatus is described for use as a coastal or river bank erosion defence or protection structure. However, numerous other applications are envisaged, such as for use as embankments, retaining walls or bunding in the form of a retaining wall around storage where potentially polluting substances are handled, processed or stored, for the purposes of containing any unintended escape of material from that area until such time as remedial action can be taken, for example to prevent oil spillage around an oil well, or as a flood defence.

When used as bunding or flood defence barriers, the drainage channels 3 may be omitted so that the blocks can define a water/oil impervious barrier. For such application the blocks may be supplied as hollow bodies, such as formed from a plastic and produced by a blow moulding or rotational moulding process, such that the blocks may be filled with a ballast material, such as water or sand, preferably on site, via a suitable filler opening.

The blocks may be any size, may be solid or hollow and may be made of any material, including plastic, rubber, recycled materials or concrete.

The invention is not limited to the embodiments described herein but can be amended or modified without departing from the scope of the present invention, which is intended to be limited only by the scope of the appended claims as interpreted according to the principles of patent law including the doctrine of equivalents.

The invention claimed is:

1. A modular building block apparatus for the construction of a coastal or river bank erosion defence or protection structure, said apparatus comprising:

a plurality of blocks arranged in stacked rows, said blocks each having a base, a top, and front and rear faces, and said blocks in each row having cooperating formations whereby said blocks in each row are interconnected with one another, apertures being formed in each block extending perpendicular to said rows; and a plurality of connector members extending through aligned ones of said apertures in adjacent rows of said blocks to interlock said adjacent rows to one another;

wherein said blocks each define at least one channel extending substantially across said base or top thereof and open at said front face, to define drainage channels between adjacent rows of said blocks when said blocks are in abutting stacked relationship.

2. The apparatus of claim 1, wherein said cooperating formations of each block comprise at least one male engagement portion extending laterally from a body of said block and at least one cooperating female engagement portion provided in said body of said block for receiving said male engagement portion of an adjacent one of said blocks.

3. The apparatus of claim 2, wherein said female engagement portion of each said block is shaped to prevent lateral movement of said cooperating male engagement portion of an adjacent one of said blocks in a respective row when received in said female engagement portion.

4. The apparatus of claim 2, wherein said male engagement portion of each block portion comprises an exterior projection which extends laterally from said body of said block.

5. The apparatus of claim 1, wherein a plurality of said rows of blocks are layered on top of one another in staggered or stepped relationship.

6. The apparatus of claim 1, wherein each of said blocks comprises first and second sides and first and second ends along with a base and a top, said first and second sides being substantially parallel to each other and said first and second ends being substantially parallel to each other such that each of said blocks has a substantially cuboid shape.

7. The apparatus of claim 1, wherein said channels extend perpendicular to said front and rear faces and are open at said rear faces.

8. The apparatus of claim 1, wherein said at least one channel comprises an elongate groove formed in said base or top of each of said blocks.

9. The apparatus of claim 8, wherein said at least one channel is formed in said base of each block.

10. The apparatus of claim 1, wherein at least one of said apertures of each of said blocks in one of said rows is aligned with an aperture of another one of said blocks in an adjacent one of said rows, said apparatus further comprising a respective connector member extending through said aligned apertures to interconnect said one of said rows with said adjacent row.

11. The apparatus of claim 10, wherein each of said connector members comprises an elongate rod, post or pin dimensioned to fit through respective aligned apertures in said blocks.

12. The apparatus of claim 11, wherein each connector member has a pointed or tapered end adapted to be inserted into a surface upon which said blocks are located.

13. The apparatus of claim 11, wherein each aperture in each of said blocks is defined by tapered walls such that a respective one of said connector members establishes an interference fit therein.

14. The apparatus of claim 1, wherein each of said blocks is made from an impermeable material.

15. The apparatus of claim 14, wherein each of said blocks is made from geopolymer cement.

16. The apparatus of claim 1, wherein each of said blocks comprises a hollow body having a filler opening to allow said block to be filled with a ballast material.

17. The apparatus of claim 16, wherein each of said blocks is made from plastic.

18. The apparatus of claim 1, further comprising at least one layer of fabric or mesh located between adjacent rows of said blocks, said layer of fabric or mesh extending laterally from said blocks to be embedded in a body of material against which said apparatus is located, to anchor said apparatus to said body of material.

19. A coastal or river bank erosion defence or protection structure comprising a modular building block apparatus as claimed in claim 1.

20. An embankment, retaining wall or flood defence barrier comprising a modular building block apparatus as claimed in claim 1.

* * * * *